US010780474B2

(12) United States Patent
Grüss et al.

(10) Patent No.: US 10,780,474 B2
(45) Date of Patent: Sep. 22, 2020

(54) ROBUST BAND TENSION CONTROL

(71) Applicant: Primetals Technologies Germany GmbH, Erlangen (DE)

(72) Inventors: Ansgar Grüss, Erlangen (DE); Daniel Kotzian, Forchheim (DE); Andreas Maierhofer, Marloffstein (DE)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 0 days.

(21) Appl. No.: 16/091,635

(22) PCT Filed: Feb. 27, 2017

(86) PCT No.: PCT/EP2017/054505

§ 371 (c)(1),
(2) Date: Oct. 5, 2018

(87) PCT Pub. No.: WO2017/178145

PCT Pub. Date: Oct. 19, 2017

(65) Prior Publication Data

US 2019/0160502 A1 May 30, 2019

(30) Foreign Application Priority Data

Apr. 14, 2016 (EP) ..... 16165233

(51) Int. Cl.
*B21B 37/52* (2006.01)
*B21B 37/46* (2006.01)
(Continued)

(52) U.S. Cl.
CPC ..... *B21B 37/52* (2013.01); *B21B 37/46* (2013.01); *B21B 37/48* (2013.01); *B21B 37/58* (2013.01);
(Continued)

(58) Field of Classification Search
CPC ..... B21B 37/48; B21B 37/60; B21B 37/64; B21B 38/06; B21B 38/08; B21B 38/10;
(Continued)

(56) References Cited

U.S. PATENT DOCUMENTS 3,237,439 A * 3/1966 Torrance ..... B21B 37/50 72/205
3,334,502 A 8/1967 Heindel et al.
(Continued)

FOREIGN PATENT DOCUMENTS

DE 1 290 234 B 3/1969
DE 26 18 901 A1 11/1976
(Continued)

OTHER PUBLICATIONS

International Search Report dated May 9, 2017 in corresponding PCT International Application No. PCT/EP2017/054505.
(Continued)

*Primary Examiner* — Adam J Eiseman
*Assistant Examiner* — Stephen Floyd London
(74) *Attorney, Agent, or Firm* — Ostrolenk Faber LLP

(57) ABSTRACT

A metal band is first rolled in a front and then in a rear (downstream) roll stand of a multi-stand rolling train. A looper between the roll stands may detect a band tension in the metal band. The band tension is supplied to a first and a second tension controller to determine an application additional target value and a speed additional target value. The second tension controller may only determine a value less than or greater than 0, as the speed additional target value, if the band tension is above or below an upper or lower band tension limit. Otherwise, the speed additional target value may be 0. The first tension controller is also supplied with
(Continued)

a target tension that falls between the band tension limits. The application additional target value may be used to act on the rear roll stand.

18 Claims, 3 Drawing Sheets

(51) Int. Cl.
*B21B 37/58* (2006.01)
*B21B 38/06* (2006.01)
*B21B 37/48* (2006.01)

(52) U.S. Cl.
CPC ..... *B21B 38/06* (2013.01); *B21B 2265/06* (2013.01); *B21B 2271/02* (2013.01); *B21B 2275/04* (2013.01)

(58) Field of Classification Search
CPC ..... B21B 2265/02; B21B 2265/06; B21B 2265/10
USPC ..... 72/8.6, 10.3, 11.4, 12.3
See application file for complete search history.

(56) References Cited

U.S. PATENT DOCUMENTS

| | | | | |
|---|---|---|---|---|
| 3,977,223 | A | 8/1976 | Edwards | 72/17 |
| 4,033,492 | A | 7/1977 | Imai | 72/6 |
| 4,909,055 | A * | 3/1990 | Blazevic | B21B 37/50 72/205 |
| 5,040,395 | A * | 8/1991 | Seki | B21B 37/50 72/8.6 |
| 5,103,662 | A | 4/1992 | Fapiano | 72/6 |
| 5,718,138 | A | 2/1998 | Imanari | 72/8.6 |
| 6,112,566 | A * | 9/2000 | Palzer | B21B 37/64 72/10.6 |
| 6,176,112 | B1 * | 1/2001 | Sykosch | B21B 37/50 72/11.4 |
| 6,227,021 | B1 * | 5/2001 | Imanari | B21B 37/22 72/11.4 |
| 2007/0068210 | A1 * | 3/2007 | Pittner | B21B 37/165 72/10.1 |
| 2012/0324971 | A1 * | 12/2012 | Simaan | B21B 37/50 72/7.4 |
| 2013/0000371 | A1 * | 1/2013 | Kasai | B21B 37/58 72/10.4 |

FOREIGN PATENT DOCUMENTS

| | | | | |
|---|---|---|---|---|
| DE | 691 02 489 | T2 | 3/1995 | |
| DE | 694 12 099 | T2 | 12/1998 | |
| DE | 10159608 | A1 * | 7/2003 | B21B 37/48 |
| EP | 0 455 381 | A1 | 11/1991 | |
| EP | 0 710 513 | A1 | 5/1996 | |
| GB | 1 501 627 | A | 2/1978 | |
| RU | 2268800 | C2 * | 1/2006 | |
| SU | 528975 | A1 | 9/1976 | |

OTHER PUBLICATIONS

Written Opinion dated May 9, 2017 in corresponding PCT International Application No. PCT/EP2017/054505.

Extended European Search Report dated Aug. 16, 2016 in corresponding European Patent Application No. 16165233.4.

Russian Federation Office Action and Search Report, dated Apr. 23, 2020, issued in corresponding Russian Federation Patent Application No. 2018134024/05(055950). English Translation. Total 22 pages.

* cited by examiner

ROBUST BAND TENSION CONTROL

CROSS-REFERENCE TO RELATED APPLICATIONS

The present application is a 35 U.S.C. §§ 371 national phase conversion of PCT/EP2017/054505, filed Feb. 27, 2017, which claims priority of European Patent Application No. 16165233.4, filed Apr. 14, 2016, the contents of which are incorporated by reference herein. The PCT International Application was published in the German language.

The present invention is directed to a tension control method for a metal strip, which is first rolled in a front roll stand of a multi-stand rolling train and then rolled in a rear roll stand of the multi-strand rolling train.

A strip tension, which prevails in the metal strip between the front roll stand and the rear roll stand, is detected by means of a looper applied to the metal strip between the front roll stand and the rear roll stand.

The strip tension is supplied to a first tension controller, which determines an adjustment additional setpoint value.

The strip tension is furthermore supplied to a second tension controller, which determines a velocity additional setpoint value. The second tension controller determines a value less than 0 as the velocity additional setpoint value if the strip tension is below a lower strip tension limit, determines a value greater than 0 as the velocity additional setpoint value if the strip tension is above an upper strip tension limit, and returns the velocity additional setpoint value to the value 0 if the strip tension is between the lower and the upper strip tension limits.

the adjustment additional setpoint value acts on the rear roll stand, and the velocity additional setpoint value acts with positive sign on the front roll stand or acts with negative sign on the rear roll stand.

The present invention is furthermore directed to a computer program, which comprises machine code, which is processable by a control unit for a rolling train, wherein a metal strip is firstly rolled in a front roll stand of a multi-stand rolling train and then in a rear roll stand of the multi-stand rolling train, a strip tension, which prevails in the metal strip between the front roll stand and the rear roll stand, is detected by means of a looper applied to the metal strip between the front roll stand and the rear roll stand.

The processing of the machine code by the control unit causes.

the control unit to accept the detected strip tension, the control unit to implement a first tension controller, to which the strip tension is supplied and which determines an adjustment additional setpoint value, the control unit furthermore to implement a second tension controller, to which the strip tension is supplied and which determines a velocity additional setpoint value, the control unit to implement the second tension controller such that the second tension controller determines a value less than 0 as the velocity additional setpoint value if the strip tension is below a lower strip tension limit, determines a value greater than 0 as the velocity additional setpoint value if the strip tension is above an upper strip tension limit, and returns the velocity additional setpoint value to the value 0 if the strip tension is between the lower and the upper strip tension limits, and the adjustment additional setpoint value to act on the rear roll stand, and the velocity additional setpoint value to act with positive sign on the front roll stand or to act with negative sign on the rear roll stand.

The present invention is furthermore directed to a control unit for a multi-stand rolling train for rolling a metal strip, wherein the control unit is programmed with such a computer program.

The present invention is furthermore directed to a multi-stand rolling train for rolling a metal strip, wherein the rolling train has a front and a rear roll stand, in which the metal strip is rolled, wherein the rolling train has a looper arranged between the front roll stand and the rear roll stand, which looper is applied to the metal strip and which detects a strip tension that prevails between the front roll stand and the rear roll stand in the metal strip, wherein the rolling train has such a control unit, to which the strip tension is supplied and which acts on the rear roll stand.

A tension control method and the associated rolling train are known, for example, from U.S. Pat. No. 3,977,223 A. In the tension control method known from U.S. Pat. No. 3,977,223 A, an adjustment additional setpoint value and a velocity additional setpoint value for the rear roll stand are computed on the basis of a position deviation of the looper. In order that such a computation is possible, the looper has to be pressed with a certain, previously known torque against the metal strip. It is checked whether the detected position lies within a previously defined strip width. If this is the case, no control interventions take place. Both the first and also the second tension controller therefore determine the value 0 as the respective additional setpoint value. The two tension controllers determine a value not equal to 0 as the respective additional setpoint value only when the detected position leaves the predefined strip width. In this case, however, both tension controllers determine a value not equal to 0. The two tension controllers therefore act with equal rank.

In the case of finish rolling in a hot strip train, narrow thickness tolerances of the hot-rolled metal strip are an important quality feature. To maintain the tolerances, on the one hand, a good mechanical state of the rolling train is required. Furthermore, a well-designed automation and control concept is also required.

A finishing train generally consists of five to seven roll stands. Each roll stand has a unit for setting the roll gap. In this case, this is often a hydraulic adjustment. In some cases, it is a mechanical-electrical adjustment. The respective roll stand causes a thickness reduction of the metal strip during the rolling of the metal strip. In general, a looper, which is applied to the metal strip, is arranged between the individual roll stands. The looper is often used for the purpose of performing a short-term buffering of a respective portion of the metal strip. Furthermore, the looper can be used as a sensor for the strip tension.

In order that the rolled metal strip can be rolled with the required thickness tolerances, firstly a suitable pass schedule is required in the scope of the operation of the finishing train. Furthermore, a well-adapted basic automation is required. The basic automation has the object of minimizing thickness deviations which occur at the output of the finishing train as much as possible and keeping the rolling process stable.

An instability of the rolling process can occur, for example, as a result of a disturbance, for example, a change of the intake-side thickness of the metal strip. A further disturbance which can result in an instability is, for example, a change of the hardness of the metal strip. Such disturbances change—with respect to a respective roll stand—the intake-side and the output-side velocity of the metal strip and thus result in a change of the strip tension. Depending on the direction of the change, the strip tension can rise enough that the strip tears or drop enough that a strip loop forms between successive roll stands.

The disturbances per se are unavoidable in practice. The object of the basic automation is to compensate for these disturbances in a timely manner by changing individual process variables and at the same time to maintain or reestablish the required exit thickness, with which the metal strip exits the finishing train. The process variables which are changed by means of the basic automation are, for example, the velocity of the rolls, the position of the adjustment, the position of the looper, and others.

The classic control concept in the basic automation of a finishing train in the case of hot rolling uses the looper and the stand velocity to compensate for disturbances which act on the intake-side and the outlet-side strip velocity and thus to stabilize the finishing train. In this control concept, the looper is held on the metal strip via a strip tension controller in order to set the required strip tension. The angle or—equivalently thereto—the position of the looper is used for this purpose in order to adapt the stand velocity. By adapting the stand velocity, the velocity changes of the metal strip are compensated for and the required strip reserve in the interstand region is reestablished. In order that no tension variations are induced in other interstand regions as a result of velocity changes, velocity changes of the roll stands are relayed by a reverse cascade or by a forward cascade to the other roll stands. Changes of the intake-side thickness of the metal strip and hardness variations of the metal strip are adjusted out via the compensation of the stand deflection (AGC=automatic gauge control or automatic gap control).

In the ideal case, the output-side thickness of the metal strip after the respective roll stand thus remains constant. Remaining thickness deviations at the exit of the finishing train are adjusted out via a thickness monitor control by adapting the adjustment position and the stand velocity. The thickness monitor controller acts at least on the last roll stand of the rolling train, often also on the next-to-last roll stand, in some cases also even further back.

A strip tension controller having an electrical looper is known from EP 0 710 513 A1, wherein the stand velocities are adapted. Furthermore, a method is described in the cited EP document, by means of which the control signals for the roll velocity and the looper torque can be determined such that a control of the roll velocity and the looper torque decoupled from one another can take place.

A strip tension controller having a hydraulic looper is known from U.S. Pat. No. 5,718,138 A, wherein a control of the looper position takes place in conjunction with an AGC. Furthermore, a method is described in the cited US document, by means of which the control signals for the looper and AGC can be determined such that a control decoupled from one another can take place.

In the case of cold rolling, in general a different control concept is used in the scope of the basic automation. One substantial difference is that the strip tension is controlled via an adaptation of the adjustment position or via an adaptation of the stand velocity by means of a so-called ITC (=interstand tension control). For this purpose, the stand velocity is typically only adapted at a standstill and at very low velocities, in all other operating states the adjustment position is adapted. By measuring the thickness and the strip velocity before and after the first roll stand of the cold rolling train, a constant mass flow in the first roll stand can be set by means of a mass flow controller, a thickness pilot controller, and a thickness controller. Furthermore, the compensation of the stand deflection (AGC) and the loop controller are not used.

A strip tension controller in a cold tandem train is known from EP 0 455 381 A1, in which deviations of the strip tension as a result of incorrect velocity relationships are suppressed.

A tension control method for a metal strip, which is firstly rolled in a front roll stand and then in a rear roll stand, is known from GB 1 501 627 A. The tension is detected and controlled to a setpoint tension. The adjustment of the front or the rear roll stand is used as the control variable.

Rolling a metal strip firstly in a front roll stand and then in a rear roll stand is known from DE 1 290 234 B or corresponding U.S. Pat. No. 3,334,502 A, which has the same content. A looper is arranged between the two roll stands. The looper angle is detected and controlled to a setpoint value. The adjustment of the rear roll stand is used as the control variable.

A tension control method for a metal strip, which is firstly rolled in a front roll stand and then in a rear roll stand, is known from DE 26 18 901 A or corresponding U.S. Pat. No. 4,033,492 A, which has the same content. The tension is detected and controlled to a setpoint tension. The adjustment of the looper and additionally the velocity of the front roll stand are used as control variables.

SUMMARY OF THE INVENTION

The object of the present invention is to provide possibilities, by means of which a control concept for the basic automation is implemented, and therefore in spite of the existing interfering influences, the required thickness tolerances can be maintained well and the rolling process remains stable at the same time.

The object is achieved by a tension control method according to the invention.

According to the invention, a tension control method of the type mentioned at the outset is embodied in that,

- a setpoint tension, which lies between the lower and the upper strip tension limit, is additionally supplied to the first tension controller,
- the first tension controller determines the adjustment additional setpoint value using a determination rule on the basis of the deviation of the strip tension from the setpoint tension, and
- the determination rule also permits a value not equal to 0 as the adjustment additional setpoint value if the strip tension is between the lower and the upper strip tension limits.

According to the invention, the strip tension is thus primarily and predominantly controlled by means of the adjustment additional setpoint value. However, if the strip tension leaves the permissible interval defined by the lower and the upper strip tension limit in spite of this control, influence is additionally exerted on the velocity at which the front or the rear roll stand is operated. The first and the second tension controller can be designed as needed. They are preferably controllers having integral behavior, for example, (solely) I controllers, PI controllers, or PID controllers.

It is possible that the adjustment additional setpoint value is a rolling force additional setpoint value. In this case, the rear roll stand is operated in a manner controlling the rolling force. Alternatively, it is possible that the adjustment additional setpoint value is a roll gap additional setpoint value.

In this case, the rear roll stand is operated in a manner controlling the roll gap. Both embodiments lead to good results.

In the case of the roll gap control, it is preferably provided that a lower and an upper adjustment limit value are supplied to the first tension controller, and the first tension controller limits the output adjustment additional setpoint value at the bottom to the lower adjustment limit value and at the top to the upper adjustment limit value. Furthermore, in this case, the upper and the lower adjustment limit values are dynamically determined by a lower and an upper limit value determining unit as a function of a rolling force, with which the metal strip is rolled in the rear roll stand, and the adjustment additional setpoint value, and specified to the first tension controller. A dynamic adaptation is thus possible in dependence on the operating state of the rear roll stand.

In particular, it is possible that the lower limit value determining unit raises the lower adjustment limit value, as long as the rolling force, with which the metal strip is rolled in the rear roll stand, exceeds an upper rolling force limit value, and otherwise keeps the lower adjustment limit value at a predetermined distance from the adjustment additional setpoint value, and the upper limit value determining unit lowers the upper adjustment limit value, as long as the rolling force, with which the metal strip is rolled in the rear roll stand, falls below a lower rolling force limit value, and otherwise keeps the upper adjustment limit value at a predetermined distance from the adjustment additional setpoint value. The rear roll stand can thus always be operated within a permissible rolling force range. The two limit value determining units therefore preferably have an integral behavior.

If the second tension controller determines a velocity additional setpoint value not equal to 0, i.e., if the strip tension falls below the lower strip tension limit or exceeds the upper strip tension limit, the second tension controller preferably defines the velocity additional setpoint value such that the strip tension is set to the lower or upper strip tension limit, respectively.

It is preferably provided that the looper is held at a defined position by means of a position controller. Variations of the strip tension thus do not have an effect on the position of the looper. A negative influence on the stability of the rolling process is thus avoided.

It is possible that the metal strip is cold rolled in the front roll stand and the rear roll stand. However, the metal strip is preferably hot rolled in the front roll stand and the rear roll stand.

The object is furthermore achieved by a computer program according to the invention. According to the invention, a computer program of the type mentioned at the outset is embodied such that the processing of the machine code by the control unit causes the first tension controller to determine the adjustment additional setpoint value using a determination rule on the basis of the deviation of the strip tension from a setpoint tension, which lies between the lower and the upper strip tension limits, and causes the determination rule also to permit a value not equal to 0 as the adjustment additional setpoint value if the strip tension is between the lower and the upper strip tension limits.

Advantageous embodiments of the computer program correspond to those of the tension control method.

The object is furthermore achieved by a control unit having the features disclosed herein. According to the invention, the control unit is embodied such that it is programmed with a computer program according to the invention.

The object is furthermore achieved by a multi-stand rolling train for rolling a metal strip having the features disclosed herein in a multi-stand rolling train of the type mentioned at the outset.

Further advantages and details result from the following description of exemplary embodiments in conjunction with the drawings. In the schematic Figures.

DESCRIPTION OF EMBODIMENT

Figure 1:
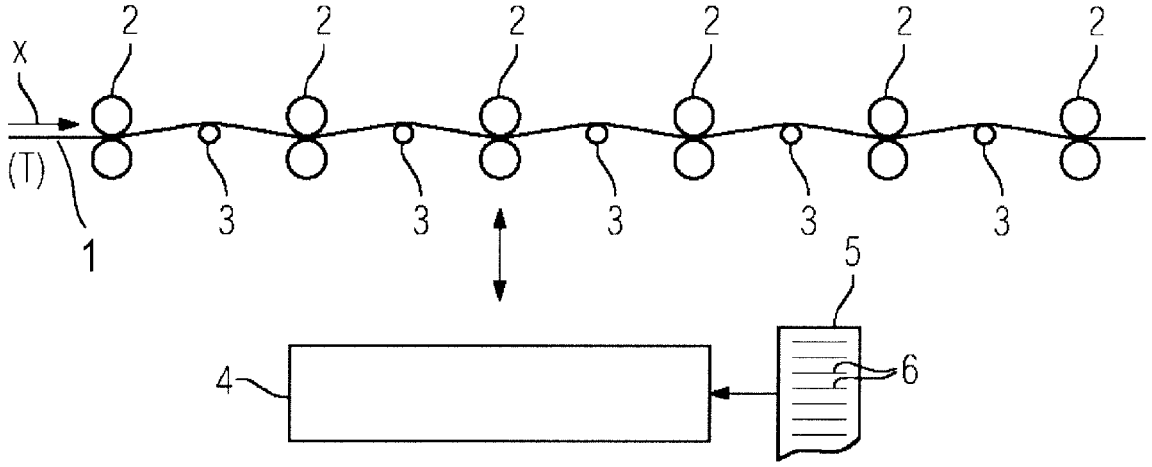
FIG. 1 shows a multi-stand rolling train.

According to FIG. 1, a metal strip 1 is to be rolled by means of a rolling train. The metal strip 1 can consist, for example, of steel or aluminum alternatively of another metal. The rolling train has multiple roll stands 2 for rolling the metal strip 1. The first roll stand is the front roll stand in the path of the strip. The second or later roll stand is a rear roll stand. In general, the number of roll stands 2 is between three and eight, in particular between four and seven, for example, five or six. The roll stands 2 generally have working rolls and support rolls, i.e., they are designed as quarto stands. In some cases, the roll stands 2 also have intermediate rolls in addition to the working rolls and the support rolls and are thus designed as sexto stands. Only the working rolls are shown in FIG. 1 and in FIG. 2.

The metal strip 1 passes through the roll stands 2 of the rolling train sequentially one after another in a transportation direction x. The metal strip 1 is rolled in the roll stands 2. The thickness of the metal strip 1 is thus gradually reduced in the transportation direction. A looper 3, which is applied to the metal strip 1, is respectively arranged between each two successive roll stands 2. The metal strip 1 may enter the first roll stand 2 of the rolling train, for example, at a temperature T which is between 850° C. and 1100° C. In this case, the metal strip 1 is hot rolled in the roll stands 2. In principle, however, it is also possible that the metal strip 1 is cold rolled in the roll stands 2.

The rolling train is controlled by a control unit 4. The control unit 4 is programmed using a computer program 5. The code is stored on a non-transitory recording medium. The computer program 5 comprises machine code 6. The machine code 6 is processable by the control unit 4. As a result of the processing, the control unit 4 executes a tension control method, which explained in greater detail hereafter.

Figure 2:
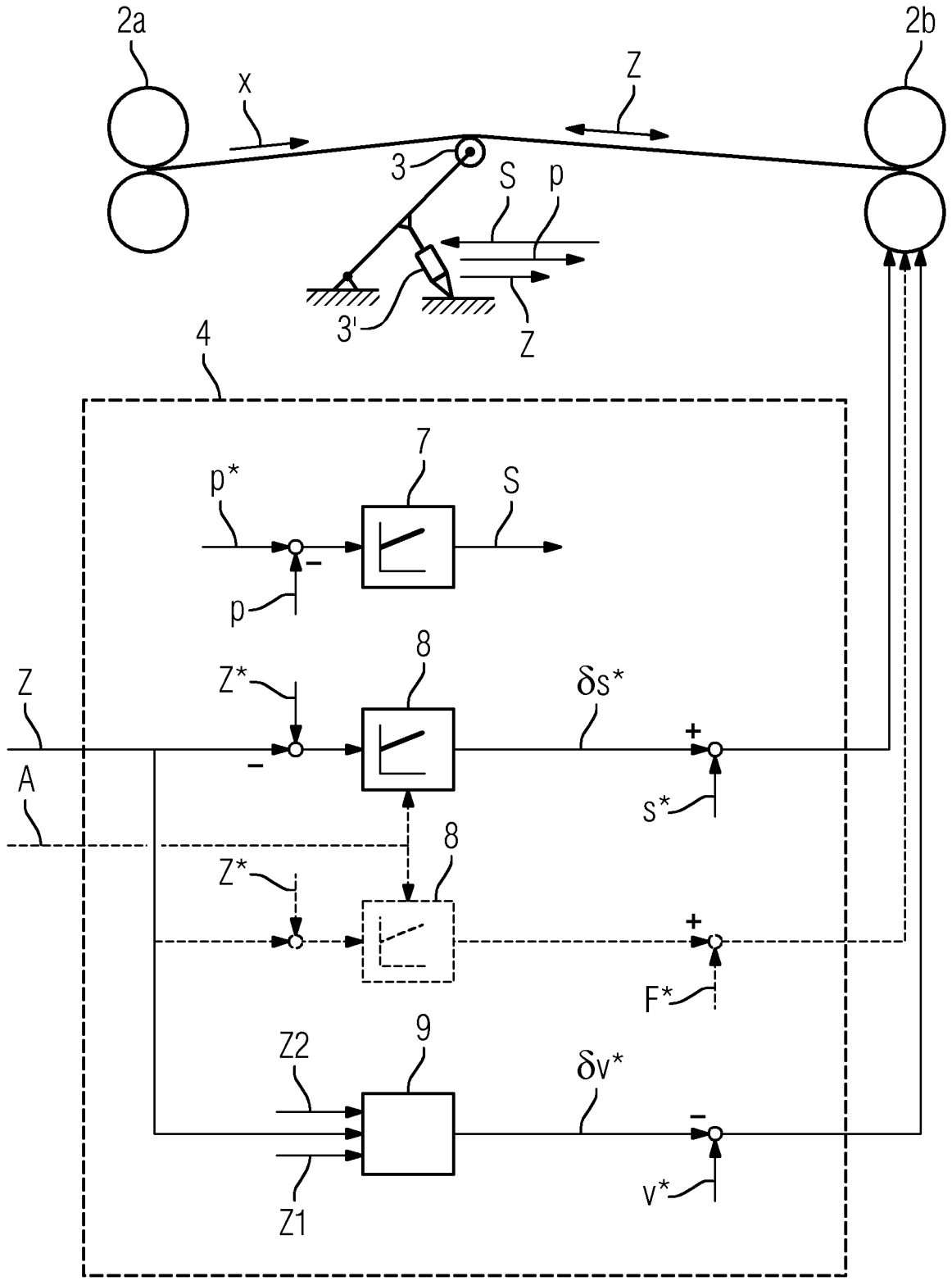
FIG. 2 shows a front and a rear roll stand, a looper arranged between these two roll stands and also shows a control unit.

The tension control method relates in each case to a portion of the metal strip 1, which is located between two directly successive roll stands 2. FIG. 2 shows such a portion of the metal strip 1, the two participating roll stands 2, and the looper 3 between these two roll stands 2. The present invention is explained hereafter in conjunction with these two roll stands 2 and the looper 3 between these two roll stands 2. The roll stand 2 through which the metal strip 1 first passes is referred to hereafter as the front roll stand. The roll stand 2*b* through which the metal strip 1 passes thereafter is referred to hereafter as the rear roll stand. The looper 3 is simply referred to as the looper 3, which means the looper 3 between the front roll stand 2*a* and the rear roll stand 2*b*.

The looper 3 is applied to the metal strip 1. For example, the control unit 4 can implement a position controller 7 to apply the looper 3 to the metal strip 1, as a result of the processing of the machine code 6. In this case, a corresponding position setpoint value p* is supplied to the position controller 7. The position setpoint value p* is generally constant. The position setpoint value p* can be generated, for example, inside the control unit 4. Alternatively, it can be externally specified to the control unit 4.

Furthermore, a corresponding position actual value p is supplied to the position controller 7. The position controller 7 then determines a control signal S for a positioning element 3' (for example, a hydraulic cylinder unit), by means of which the position of the looper 3 is tracked if necessary, depending on the control deviation, i.e., the difference of position setpoint value p* and position actual value p. As a result, the looper 3 is therefore kept at a defined position by means of the position controller 7, namely the position setpoint value p*. The position controller 7 can be designed as needed. The position controller 7 is preferably designed as a controller having an integral component, for example, as a PI controller.

Furthermore, a strip tension Z, which prevails in the metal strip 1 between the front roll stand 2*a* and the rear roll stand 2*b*, is detected by the looper 3. For example, a torque exerted by the positioning element 3' on the looper 3 or a corresponding force can be detected and the strip tension Z can be determined therefrom in conjunction with the position actual value p and geometric relationships of the roll stands 2*a*, 2*b* and the looper 3 in relation to one another. However, the looper 3 preferably has a load cell, by means of which the force with which the looper roll is pressed against the looper 3 is detected directly. A more accurate determination of the strip tension Z is thus possible.

The detected strip tension Z is supplied to the control unit 4 and accepted by the control unit 4. The control unit 4 implements a first tension controller 8 and a second tension controller 9 by processing the machine code 6. The strip tension Z is supplied to the first tension controller 8 and the second tension controller 9.

The first tension controller 8 determines an adjustment additional setpoint value δs* using a determination rule. The adjustment additional setpoint value δs* can be in particular a roll gap additional setpoint value δs*. The adjustment additional setpoint value δs* is connected in this case to an adjustment setpoint value s* given as a roll gap setpoint value s*.

The second tension controller 9 determines a velocity additional setpoint value δv*. The velocity additional setpoint value δv* is connected to a velocity setpoint value v*. The adjustment additional setpoint value δs* acts on the rear roll stand 2*b*. In particular, the adjustment additional setpoint value δs* acts on the adjustment of the rear roll stand 2*b*. The velocity additional setpoint value δv* can act on drives by means of which the rolls of the rear roll stand 2*b* are rotated. In this case, the velocity additional setpoint value δv* also acts on the rear roll stand 2*b*, corresponding to the illustration in FIG. 2. Alternatively, the velocity additional setpoint value δv* could act on the front roll stand 2*a*.

Figure 3:
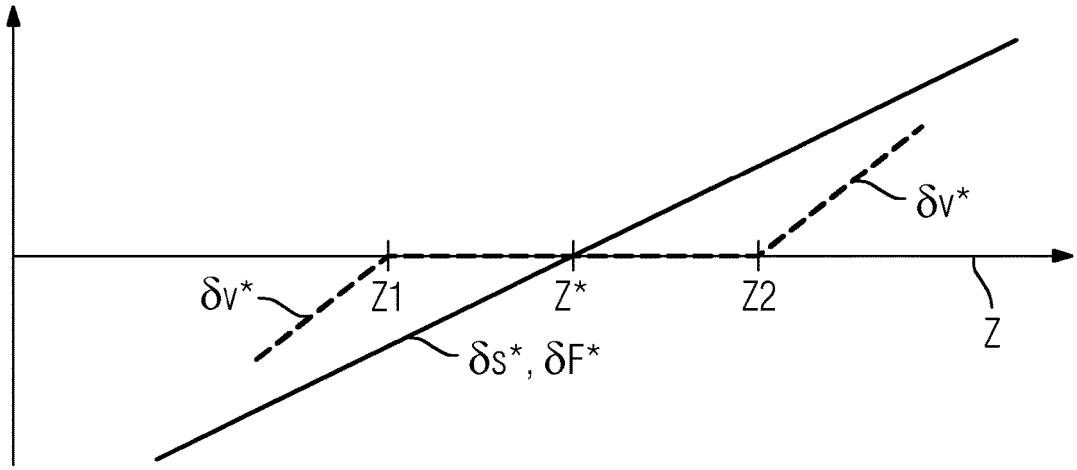
FIG. 3 shows control variables as a function of the strip tension.

In addition to the strip tension Z, a lower strip tension limit Z1 and an upper strip tension limit Z2 are supplied to the second tension controller 9. The upper strip tension limit Z2 is greater than the lower strip tension limit Z1. If and as long as the strip tension Z lies between the lower and upper strip tension limits Z1, Z2, the velocity additional setpoint value δv* determined by the second tension controller 9 has the value 0, corresponding to the illustration in FIG. 3. If and as long as the strip tension Z lies above the upper strip tension limit Z2, in contrast, the second tension controller 9 determines a value greater than 0 as the velocity additional setpoint value δv*. Vice versa, if and as long as the strip tension Z lies below the lower strip tension limit Z1, the second tension controller 9 determines a value less than 0 as the velocity additional setpoint value δv*. The second tension controller 9 can determine the velocity additional setpoint value δv* in particular in such a way that the strip tension Z is set to the lower strip tension limit Z1 in the case that it falls below the lower strip tension limit Z1 and, vice versa, it is set to the upper strip tension limit Z2 in the case that it exceeds the upper strip tension limit Z2. If the strip tension Z again assumes a value between the lower and the upper strip tension limits Z1, Z2 after exceeding the upper strip tension limit Z2 or after falling below the lower strip tension limit Z1, the second tension controller 9 returns the velocity additional setpoint value δv* back to the value 0. The second tension controller 9 is preferably formed as a controller having an integral component, for example, as a PI controller.

If the velocity additional setpoint value δv* determined by the second tension controller 9 acts on the rear roll stand 2*b*, the velocity additional setpoint value δv* is added with a negative sign to a velocity setpoint value v* for the rear roll stand 2*b*, corresponding to the illustration in FIG. 2. Otherwise, if the velocity additional setpoint value δv* acts on the front roll stand 2*a*, the velocity additional setpoint value δv* is added with a positive sign to a velocity setpoint value for the front roll stand 2*a*.

In addition to the strip tension Z, a setpoint tension Z* is supplied to the first tension controller 8. The setpoint tension Z* lies between the lower and upper strip tension limits Z1, Z2. In particular, the setpoint tension Z* can lie approximately or even exactly in the middle between the lower and the upper strip tension limits Z1, Z2. In general, the equation $Z^*=kZ1+(1-k)\,Z2$ applies, wherein the factor k is generally between 0.4 and 0.6, preferably even between 0.45 and 0.55. The first tension controller 8 determines the adjustment additional setpoint value δs* on the basis of the deviation of the strip tension Z from the setpoint tension Z. In contrast to the determination rule of the second tension controller 9, the determination rule for the first tension controller 8 also permits a value not equal to 0 as the adjustment additional setpoint value δs* if the strip tension Z lies between the lower and the upper strip tension limits Z1, Z2. The respective instantaneously determined adjustment additional setpoint value δs* can temporarily have the value 0 in the specific case. However, this is caused in this case by the specific values for the strip tension Z and the setpoint tension Z* and possibly the prior value curves thereof, but not by the fact that the strip tension Z lies between the lower and the upper strip tension limits Z1, Z2.

The determination rule can be, for example, such that the first tension controller 8 is designed as a controller having an integral component, for example, as a PI controller. If the instantaneous integral component is positive in such a case and the instantaneous proportional component is negative, the integral component and the proportional component can mutually compensate one another for a brief moment. If the deviation of the strip tension Z from the setpoint tension Z* is not equal to 0 for a longer time, however, necessarily at some point in time, the determined adjustment additional setpoint value δs* has to assume a value not equal to 0. This also applies if the strip tension Z only moves between the lower and the upper strip tension limits Z1, Z2 during the entire period of time. Similar circumstances result with other embodiments of the first tension controller 8, for example, as a PID controller or as an I controller and also in an embodiment as solely a P controller.

As explained up to this point, the adjustment additional setpoint value δs* is a roll gap additional setpoint value. In this case, the adjustment additional setpoint value δs* acts directly and immediately on the adjustment of the rear roll stand 2*b*. Alternatively, however, it is possible that the adjustment additional setpoint value δF* is a rolling force additional setpoint value δF*. In this case, the adjustment additional setpoint value δF* is connected to an adjustment setpoint value F* provided as a setpoint rolling force F* and acts indirectly, specifically via the rolling force F—on the adjustment of the rear roll stand 2*b*. This embodiment is shown by dashed lines in FIG. 2. The first tension controller 8 is also preferably designed as a controller having an integral component in this case, for example, as a PI controller. The other statements on the functionality of the first tension controller 8 also apply for this case.

It is even possible, according to the illustration in FIG. 2, that the first tension controller 8 is provided twice, namely once as the first tension controller 8 for determining the roll gap additional setpoint value δs* and once as the first tension controller 8 for determining the rolling force additional setpoint value δF*. In this case, it is decided by a selection signal A whether the one or the other first tension controller 8 is active. This is also shown by dashed lines in FIG. 2. The selection signal A can be specified to the control unit 4, for example, in the scope of a parameterization before startup. It is even possible to switch over the selection signal A during the operation of the rolling train. It is thus possible to operate the roll stand 2*b* shown in FIG. 2 sometimes in a manner controlling the roll gap and sometimes in a manner controlling the rolling force, and to determine the corresponding adjustment additional setpoint value δs*, δF* depending on the instantaneous operating mode, and connect it to the corresponding adjustment setpoint value s*, F*.

Figure 4:
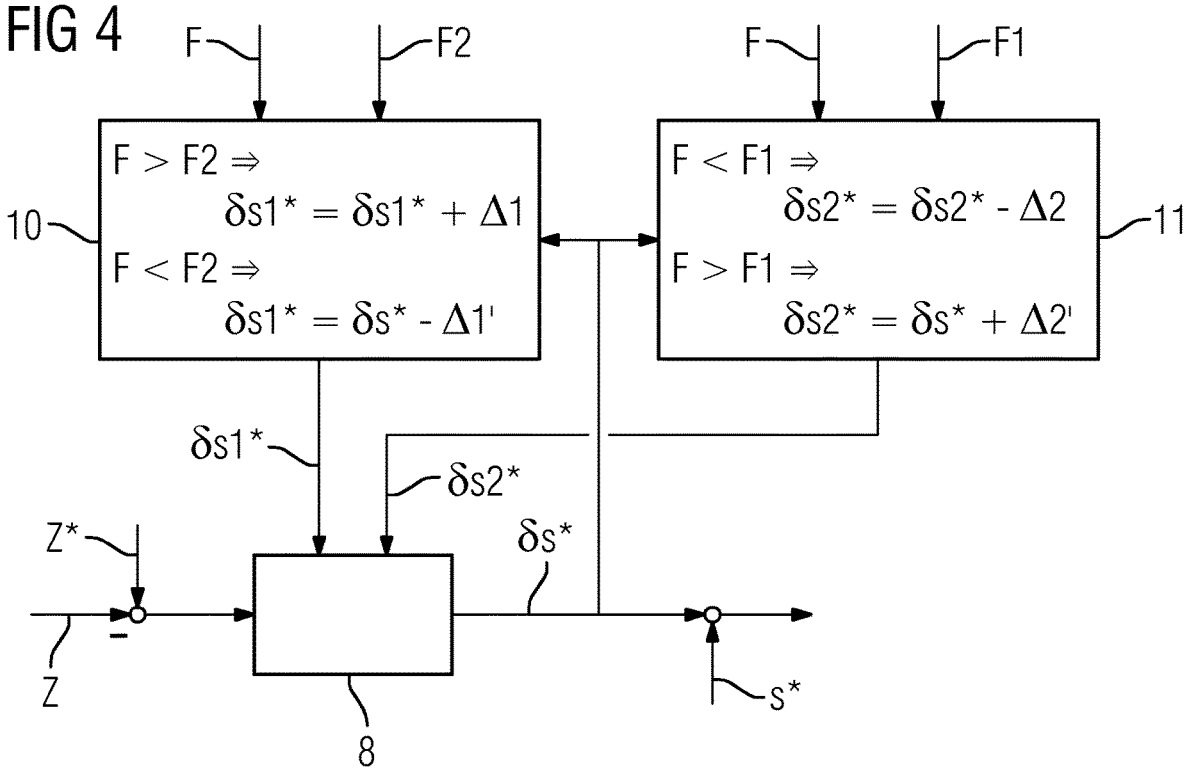
FIG. 4 shows an embodiment of a part of the control unit of FIG. 3.

FIG. 4 shows a possible modification of the first tension controller 8. The statements on FIG. 4 refer in this case to the case in which the first tension controller 8 is designed to determine the roll gap additional setpoint value δs*.

According to FIG. 4, a lower and an upper adjustment limit value δs1*, δs2* are supplied to the first tension controller 8. In this case, the first tension controller 8 limits the output adjustment additional setpoint value δs* at the bottom to the lower and at the top to the upper adjustment limit value δs1*, δs2*. The lower and the upper adjustment limit values δs1*, δs2* can be dynamically determined, for example, corresponding to the illustration in FIG. 4, by a lower and an upper limit value determining unit 10, 11 as a function of a rolling force F, with which the metal strip 1 is rolled in the rear roll stand 2*b*, and the adjustment additional setpoint value δs*. The adjustment limit values δs1*, δs2* are specified to the first tension controller 8 by the two limit value determining units 10, 11.

In particular, it is possible, corresponding to the illustration in FIG. 4, that the upper limit value determining unit 11 checks whether the rolling force F, with which the metal strip 1 is rolled in the rear roll stand 2*b*, falls below a lower rolling force limit value F1. If this is the case, the upper limit value determining unit 11, proceeding from the last valid value for the upper adjustment limit value δs2*, reduces the upper adjustment limit value δs2* by a defined absolute value Δ2. The absolute value Δ2 can alternatively be constant or can depend on the amount by which the rolling force F falls below the lower rolling force limit value F1. Otherwise, the upper limit value determining unit 11 establishes the upper adjustment limit value δs2* such that it has a predetermined distance Δ2' from the presently valid value of the adjustment additional setpoint value δs*.

In a similar manner, it is possible, corresponding to the illustration in FIG. 4, that the lower limit value determining unit 10 checks whether the rolling force F, with which the metal strip 1 is rolled in the rear roll stand 2*b*, exceeds an upper rolling force limit value F2. If this is the case, proceeding from the last valid value for the lower adjustment limit value δs1*, the lower limit value determining unit 10 elevates the lower adjustment limit value δs1* by a defined absolute value Δ1. The absolute value Δ1 can alternatively be constant or can depend on the amount by which the rolling force F exceeds the upper rolling force limit value F2. Otherwise, the lower limit value determining unit 10 establishes the lower adjustment limit value δs1* such that it has a predetermined distance Δ1' from the presently valid value of the adjustment additional setpoint value δs*. The distance Δ1' can be, but does not have to be the same distance Δ2', which is set by the upper limit value determining unit 11 if the rolling force F does not fall below the lower rolling force limit value F1.

The reduction of the upper adjustment limit value δs2* can go so far that the upper adjustment limit value δs2* is less than the (actual) adjustment additional setpoint value δs*. In this case, the limiting by the upper adjustment limit value δs2* acts. The first tension controller 8 is therefore no longer capable of compensating for the deviation of the strip tension Z from the setpoint tension Z*. This has the result that the deviation of the strip tension Z from the setpoint tension Z* becomes greater until one of the strip tension limits Z1, Z2 is infringed. In this case, the second tension controller 9 engages in a corrective manner. Similar statements apply for the case in which the lower adjustment limit value δs1* is elevated further.

The present invention has many advantages. The rolling force and strip tension limits are thus reliably maintained even under unfavorable conditions (for example, overload or underload of the rear roll stand 2*b*). The rolling process is stabilized. This applies in particular in comparison to an ITC. By means of the tension control method according to the invention, for example, even a metal strip 1 having a thickness of 1 mm or less may be rolled stably and reliably in the scope of an endless casting-rolling method. This also applies to a conventional finishing train (HSM=hot strip mill). Furthermore, the hydraulic drive of the looper 3 can be simplified. This results in a cost reduction.

A further advantage is that neither an AGC nor a loop controller are required. It is merely required that the looper 3 does not move during the tension control. However, this can be readily ensured by the position controller 7. A superordinate thickness controller is required to compensate for thickness deviations at the exit of the rolling train. However, the thickness controller is also required in the prior art and also corresponds to the embodiment of the prior art.

Furthermore, the problems which occur in the case of an AGC are avoided by the control according to the invention of the strip tension Z. This is because in the case of control using AGC, the stand deflection has to be known very accurately, in order to achieve good results. It is problematic in this case that due to inadequate modeling of the stand deflection, the AGC is overcompensated and this results in an unstable rolling process. In the present invention, in contrast, the AGC is neither required nor used, and the stand deflection is also not required for a good compensation.

A further advantage is that a complex decoupling of a strip tension controller and loop controller is not required, since the strip tension controller has a different positioning element than is typical in the prior art and the loop controller is not required.

The above description serves exclusively to explain the present invention. The scope of protection of the present invention is exclusively to be defined by the appended claims, in contrast.

LIST OF REFERENCE SIGNS

1 metal strip
2, 2*a*, 2*b* roll stands
3 looper
3' positioning element
4 control unit
5 computer program
6 machine code
7 position controller
8, 9 tension controller
10, 11 limit value determining unit
A selection signal
F rolling force
F*, s* adjustment setpoint values
F1, F2 rolling force limit values
k factor
p, p* position values
S control signal
T temperature
v* velocity setpoint value
x transportation direction
Z strip tension
Z1, Z2 strip tension limits
Z* setpoint tension
δ change value
δ1, δ2 barriers
δs*, δF* adjustment additional setpoint value
δs1*, δs2* adjustment limit values
δv* velocity additional setpoint value
Δ1, Δ2 absolute values
Δ1', Δ2' distances

The invention claimed is:

1. A tension control method for controlling a multi-stand rolling train comprising a front roll stand rolling a metal strip and a rear roll stand rolling the metal strip after the front roll stand, the method comprising:

detecting, by a looper, a strip tension prevailing in the metal strip between the front roll stand and the rear roll stand, the looper applied to the metal strip between the front roll stand and the rear roll stand;

supplying the detected strip tension to a first tension controller configured to determine an adjustment additional setpoint value;

further supplying the detected strip tension to a second tension controller configured to determine a velocity additional setpoint value, wherein the second tension controller determines a value greater than zero as the velocity additional setpoint value when the strip tension detected is above an upper strip tension limit, determines a value less than zero as the velocity additional setpoint value when the strip tension is below a lower strip tension limit and returns the velocity additional setpoint value to a value zero when the detected strip tension is between the lower and the upper strip tension limits;

adjusting the rear roll stand based on the adjustment additional setpoint value, and adjusting at least one of the front roll stand based on the velocity additional setpoint value with positive sign and the rear roll stand based on the velocity additional setpoint value with negative sign;

supplying a setpoint tension to the first tension controller, wherein the setpoint tension lies between the lower and the upper strip tension limits;

wherein the determining of the adjustment additional setpoint value by the first tension controller is performed according to a determination rule on the basis of a deviation of the detected strip tension from the setpoint tension; and wherein according to the determination rule a value not equal to zero is set as the adjustment additional setpoint value when the detected strip tension is between the lower and the upper strip tension limits.

2. The tension control method as claimed in claim 1, wherein the adjustment additional setpoint value is a rolling force additional setpoint value.

3. The tension control method as claimed in claim 1, wherein the adjustment additional setpoint value is a roll gap additional setpoint value.

4. The tension control method as claimed in claim 3, further comprising: limiting, by the first tension controller, the adjustment additional setpoint value at the bottom to a lower adjustment limit value and at the top to an upper adjustment limit value; and dynamically determining the lower and the upper adjustment limit values as a function of a rolling force with which the metal strip is rolled in the rear roll stand, and the adjustment additional setpoint value.

5. The tension control method as claimed in claim 4, further comprising:

raising the lower adjustment limit value when the rolling force, with which the metal strip is rolled in the rear roll stand, exceeds an upper rolling force limit value, and otherwise setting a distance of the lower adjustment limit value from the adjustment additional setpoint value to a predetermined value; and lowering the upper adjustment limit value when the rolling force, with which the metal strip is rolled in the rear roll stand, falls below a lower rolling force limit value, and otherwise, setting a distance of the upper adjustment limit value from the adjustment additional setpoint value to a predetermined value.

6. The tension control method as claimed in claim 1, further comprising:

defining the velocity additional setpoint value, by the second tension controller, when the strip tension falls below the lower strip tension limit or exceeds the upper strip tension limit, such that the strip tension is set, respectively, to the lower strip tension limit or the upper strip tension limit.

7. The tension control method as claimed in claim 1, further comprising holding the looper, by a position controller, at a defined position.

8. The tension control method as claimed in claim 1, further comprising hot rolling the metal strip in the front roll stand and in the rear roll stand.

9. A non-transitory automated processor-readable medium comprising machine code recorded on the medium, and wherein the code is configured such that when the code is executed by the automated processor, the code controls a control unit of a multi-stand rolling train rolling a metal strip firstly in a front roll stand of the multi-stand rolling train and then in a rear roll stand of the multi-stand rolling train;

wherein a strip tension prevailing in the metal strip between the front roll stand and the rear roll stand, is detected by means of a looper applied to the metal strip between the front roll stand and the rear roll stand;

wherein the processing of the code by the control unit causes:

the control unit to receive the detected strip tension;

a first tension controller of the control unit, to which the strip tension is supplied, to determine an adjustment additional setpoint value;

a second tension controller of the control unit, to which the strip tension is supplied, to determine a velocity additional setpoint value;

wherein the second tension controller determines a value less than zero as the velocity additional setpoint value when the strip tension lies below a lower strip tension limit, determines a value greater than zero as the velocity additional setpoint value when the strip tension lies above an upper strip tension limit, and returns the velocity additional setpoint value to a value zero the strip tension lies between the lower and the upper strip tension limits;

adjusting of the rear roll stand according to the adjustment additional setpoint value, and adjusting of at least one of the front roll stand according to the velocity additional setpoint value with positive sign and the rear roll stand according to the velocity additional setpoint value with negative sign; and the first tension controller to determine the adjustment additional setpoint value using a determination rule on the basis of a deviation of the strip tension from a setpoint tension, which lies between the lower and the upper strip tension limits, wherein the determination rule sets a value not equal to zero as the adjustment additional setpoint value when the strip tension is between the lower and the upper strip tension limits.

10. The automated processor-readable medium as claimed in claim 9, wherein the processing of the code by the control unit causes the adjustment additional setpoint value to be a rolling force additional setpoint value.

11. The automated processor-readable medium as claimed in claim 9, wherein the processing of the code by the control unit causes the adjustment additional setpoint value to be a roll gap additional setpoint value.

12. The automated processor-readable medium as claimed in claim 11, wherein the processing of the code by the control unit causes: a lower adjustment limit value and an upper adjustment limit value to be supplied to the first tension controller the first tension controller, limiting the adjustment additional setpoint value at the bottom to the lower adjustment limit value and at the top to the upper adjustment limit value; and causes the control unit to determine dynamically the lower and the upper adjustment limit values as a function of a rolling force with which the metal strip is rolled in the rear roll stand, and the adjustment additional setpoint value.

13. The automated processor-readable medium as claimed in claim 12, wherein the processing of the code by the control unit causes:

a lower limit value determining unit to raise the lower adjustment limit value when the rolling force, with which the metal strip is rolled in the rear roll stand, exceeds an upper rolling force limit value, and otherwise to set a distance of the lower adjustment limit value from the adjustment additional setpoint value to a predetermined value, and an upper limit determining unit to lower the upper adjustment limit value when the rolling force, with which the metal strip is rolled in the rear roll stand, falls below a lower rolling force limit value, and otherwise to set a distance of the upper adjustment limit value from the adjustment additional setpoint value to a predetermined value.

14. The automated processor-readable medium as claimed in claim 9, wherein the control unit causes, when the strip tension falls below the lower strip tension limit or exceeds the upper strip tension limit, the second tension controller to define the velocity additional setpoint value such that the strip tension is set, respectively, to the lower strip tension limit or the upper strip tension limit.

15. The automated processor-readable medium as claimed in claim 9, wherein the control unit causing the control unit to implement a position controller holding the looper at a defined position.

16. The automated processor-readable medium as claimed in claim 9, wherein the control unit causing the metal strip to be hot rolled in the front roll stand and in the rear roll stand.

17. A control unit for a multi-stand rolling train for rolling a metal strip, wherein the control unit comprises the automated processor-readable medium as claimed in claim 9.

18. A multi-stand rolling train comprising the control unit as claimed in claim 17, wherein the rolling train comprises:

a front and a rear roll stand configured to roll a metal strip;

a looper arranged in the rolling train between the front roll stand and the rear roll stand, and the looper is applied to the metal strip and the looper is configured to detect a strip tension prevailing in the metal strip between the front roll stand and the rear roll stand; and the control unit for the rolling train configured to adjust the rear roll stand.

* * * * *